US005896724A

United States Patent [19]

Tofts

[11] Patent Number: 5,896,724

[45] Date of Patent: Apr. 27, 1999

[54] REINFORCING STRUT

[75] Inventor: David John Tofts, Harangba, Australia

[73] Assignee: Kalford Pty. Ltd., Queensland, Australia

[21] Appl. No.: 08/956,335

[22] Filed: Oct. 23, 1997

[30] Foreign Application Priority Data

Oct. 31, 1996 [AU] Australia ..... 70513/96

[51] Int. Cl.[6] ..... E04C 3/30

[52] U.S. Cl. ..... 52/739.1; 52/506.07

[58] Field of Search ..... 52/739.1, 506.04

[56] References Cited

U.S. PATENT DOCUMENTS

| | | |
|---|---|---|
| 3,891,021 | 6/1975 | Geoffrey . |
| 4,008,745 | 2/1977 | Bailey . |
| 4,434,594 | 3/1984 | Bliss . |
| 4,520,609 | 6/1985 | Worley et al. . |
| 4,691,494 | 9/1987 | Gwynne . |
| 4,918,890 | 4/1990 | Stafford . |
| 4,934,439 | 6/1990 | Martin . |
| 4,987,941 | 1/1991 | Wold . |
| 5,088,216 | 2/1992 | Wasiko . |
| 5,205,096 | 4/1993 | Pace . |

FOREIGN PATENT DOCUMENTS

| | | |
|---|---|---|
| 0 649 949 | 4/1995 | European Pat. Off. . |
| 0500483 | 2/1939 | United Kingdom . |
| 2 102 465 | 2/1983 | United Kingdom . |
| 2 246 384 | 1/1992 | United Kingdom . |

*Primary Examiner*—Creighton Smith

*Attorney, Agent, or Firm*—Panitch Schwarze Jacobs & Nadel, P.C.

[57] ABSTRACT

A reinforcing strut for an overhead sectional door including a pair of oppositely directed feet for fastening the reinforcing strut to the overhead sectional door and a wall extending from an end of each of the feet with the walls overlying one another and fixed to one another.

12 Claims, 4 Drawing Sheets

REINFORCING STRUT

TECHNICAL FIELD

THIS INVENTION relates to a reinforcing strut for overhead sectional doors.

BACKGROUND OF THE INVENTION

Overhead sectional doors can have a number of problems which may be overcome by placing reinforcing struts on the doors. When overhead sectional doors are in the open position, the weight of the door often causes panels of the door to bow downwardly. This is both aesthetically displeasing and can also damage the panels. Placement of struts transverse the panels can reduce the bow in the panels and also prevent the panels from damage.

Most overhead sectional doors are fitted with a remote control operator. This operator is attached to an arm which enables the door to be opened or closed. The arm exerts a pushing or a pulling force on the top of the door section which can be substantially large and may damage the panels of the door. To counter this effect, a strut can be placed at the top edge of the door to cater for these loads.

When a garage door is closed, it becomes a relatively large single surface which has to be able to resist wind pressure. In cyclonic or hurricane winds, the forces that can be generated on the panels are extremely large. The weakest areas on most overhead sectional doors are the top and the bottom edges of the door. Therefore, struts can be placed on the bottom and top edge of the door to counter wind pressure.

Currently, the struts used on overhead sectional doors that are U-shaped in cross-section. The strength of these struts can be dramatically affected by the way in which they are attached to the overhead sectional door. The struts are usually attached by the manufacturer and if not attached correctly, the door may become damaged by the three factors discussed above. Further, the struts that are currently used are quite heavy. The extra weight increases the size requirements of the springs and other components need for the overhead sectional door. This leads to a total cost increase of the overhead sectional doors. Still further, the strength of the current reinforcing struts still permits failure of overhead sectional doors at relatively low loadings.

OBJECT OF THE INVENTION

It is an object of the present invention to provide a reinforcing strut which at least minimises the disadvantages referred to above or provides the consumer a commercial choice.

DISCLOSURE OF THE INVENTION

According to one aspect, the invention provides a reinforcing strut for an overhead sectional door including a pair of oppositely directed feet for fastening the reinforcing strut to the overhead sectional door and a wall extending from an end of each of the feet with the walls in contact with and fixed to one another.

The reinforcing strut may be constructed from a single sheet of material. The material may be a metal such as a steel. The strut may be roll formed.

Any suitable conventional forms of fastening may be employed for the purposes of attaching the feet to the overhead sectional door such as welding, threaded fasteners, adhesives etc.

A lip may extend outwardly from an end of each of the feet. The top of the lip may be turned on itself to produce a dull edge. The lip is usually turned inwardly. The lip may provide additional strength to the reinforcing strut.

The distal edges of the walls may be connected to one another and may be contiguous. Where the edges are connected in this way, an enclosed structure may be formed at that location. Preferably, the enclosed structure is square in cross-sectional shape. A side of the enclosed structure may be at an angle of approximately 135° to that of the walls. A bar may be placed within the enclosed structure to provide additional strength to the reinforcing strut.

The walls may be fixed to one another via various common known fixing means such as welding, threaded fasteners, adhesives etc. Preferably, the walls are fastened to each other through a hole and corresponding folding tab arrangement.

The reinforcing struts may be produced in standard heights. The standard heights may be between 50 mm–100 mm. Preferably, the standard height may be 85 mm.

BRIEF DESCRIPTION OF THE DRAWINGS

A particular preferred embodiment of the invention will now be described with reference to the following drawings in which.

DETAILED DESCRIPTION OF EMBODIMENTS

Figure 1:
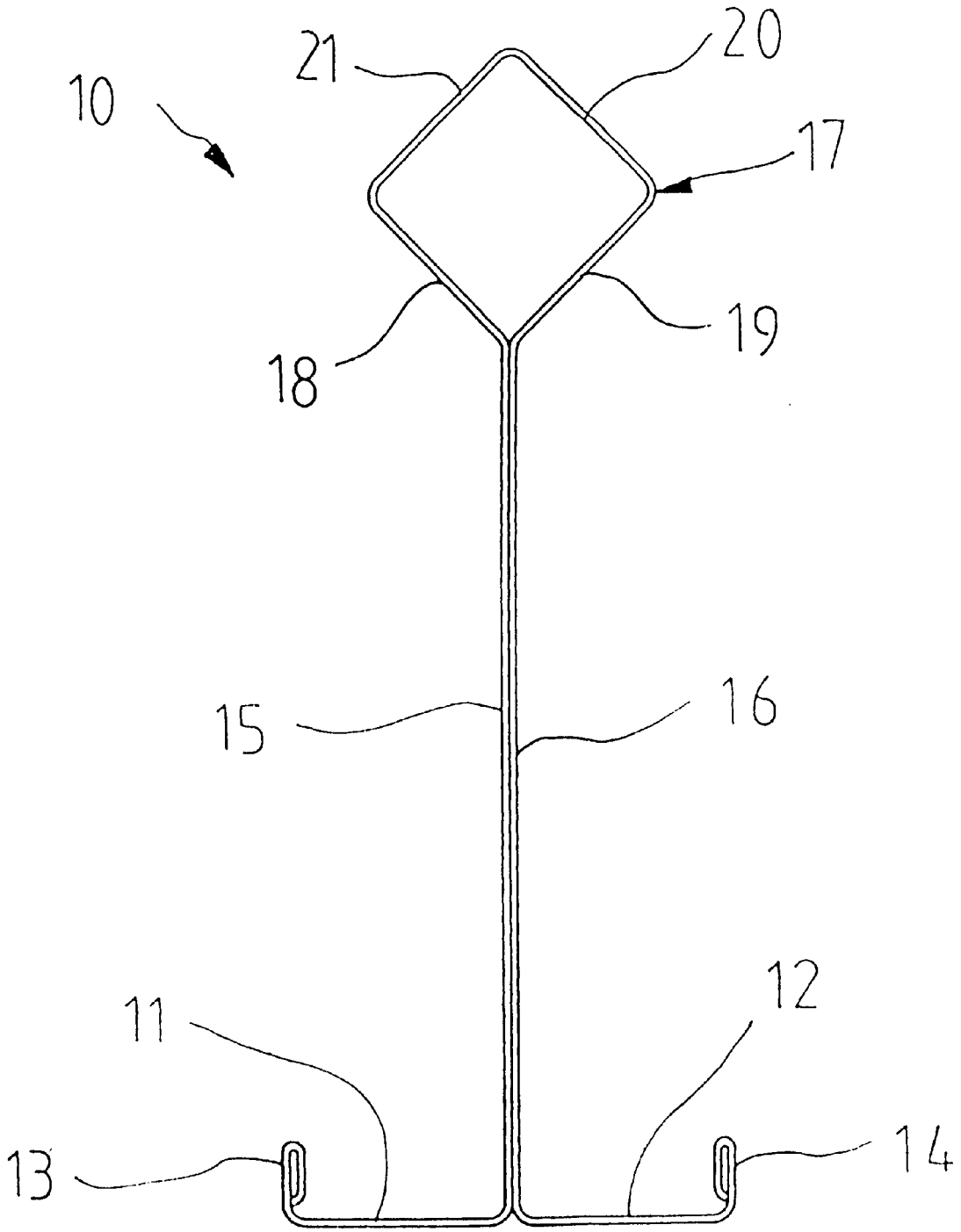
FIG. 1 is a front section view of a reinforcing strut according to an embodiment of the invention.

The reinforcing strut 10 of FIG. 1 is roll formed from a single sheet of high tensile steel. The length of the steel may be varied to suit various sizes of overhead sectional doors. The thickness of the sheet is 0.55 mm The reinforcing strut 10 has two feet 11,12 which are used to attach the reinforcing strut 10 to an overhead sectional door. The two feet 11,12 lie in the same plane with the bottom of the two feet 11,12 being substantially flat to aid in the attachment.

A lip is formed at the end of each of the two feet. The two lips 13,14 are substantially perpendicular to the feet. The tops of the two lips 13,14 have been turned inwardly back on to themselves so as to produce a dull edge.

A wall is formed at the opposite end, i.e., the inner ends, of each of the two feet. The two walls 15,16 are substantially perpendicular to the two feet 11,12. A side each of the walls 15,16 abuts against each other for the length of the reinforcing strut 10.

An enclosed structure 17 is formed at the ends of the two walls. The enclosed structure 17 is square in cross-sectional shape. There are two lower 18,19 and two upper sides 20,21 of the enclosed structure. Side 18 and wall 15 are at an angle of 135° with respect to each other. Similarly, side 19 and wall 16 are also at 135° to each other. A bar (not shown) may be placed within the enclosed structure 17 to increase the overall strength of the strut 10.

Figure 2:
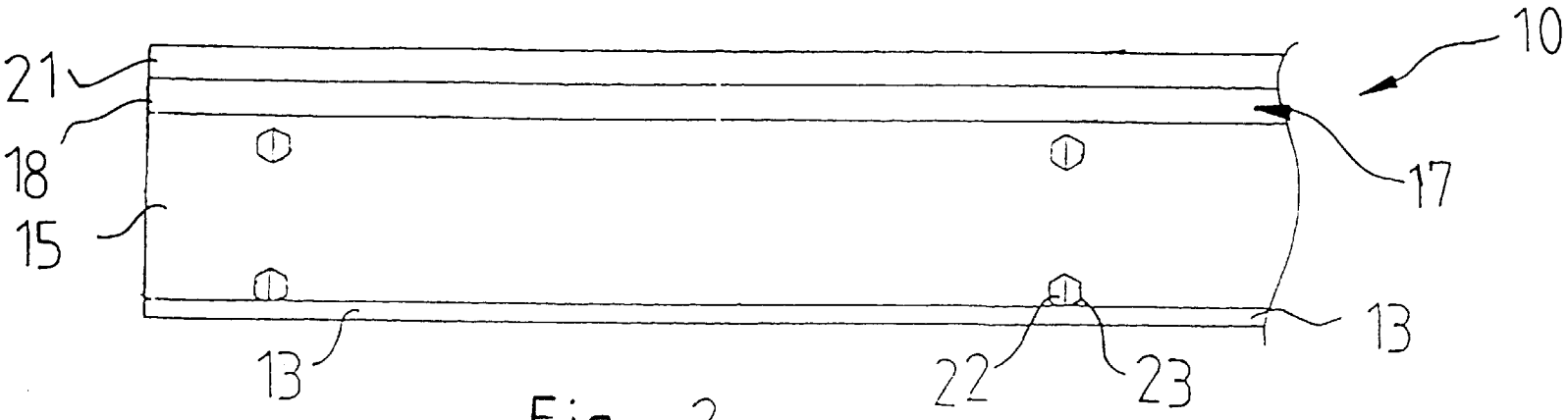
FIG. 2 is a left side view of a reinforcing strut according to FIG. 1.
Figure 3:
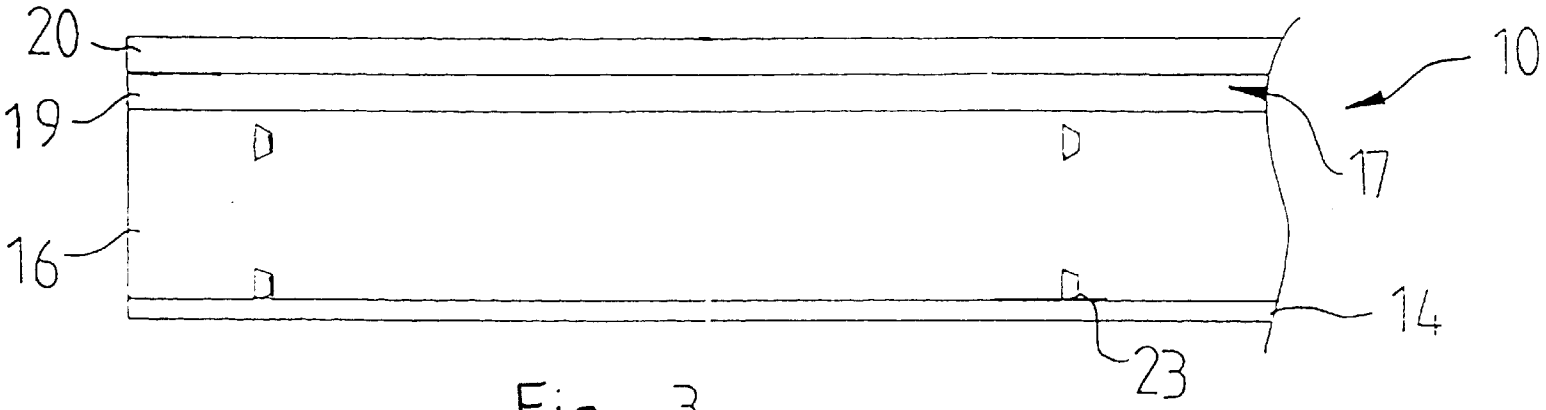
FIG. 3 is a right side view of a reinforcing according to FIG. 1.

FIGS. 2 and 3 show left and right side views of the reinforcing strut 10 before the walls 15,16 are fixed together. Trapezoidal holes 22 are punched periodically in wall 15 of the reinforcing strut 10 before roll forming. Similarly, tabs 23 are formed periodically from the right wall 16 of the reinforcing strut 10 before roll forming. Each tab 23 is trapezoid in shape and hinged on its longest side. When the reinforcing strut 10 is roll formed, the tabs 23 become aligned with the holes 22. Each tab 23 is then folded through the hole 22 until its sits flush against wall 15, thus fixing the walls 15,16 together.

Figure 4:
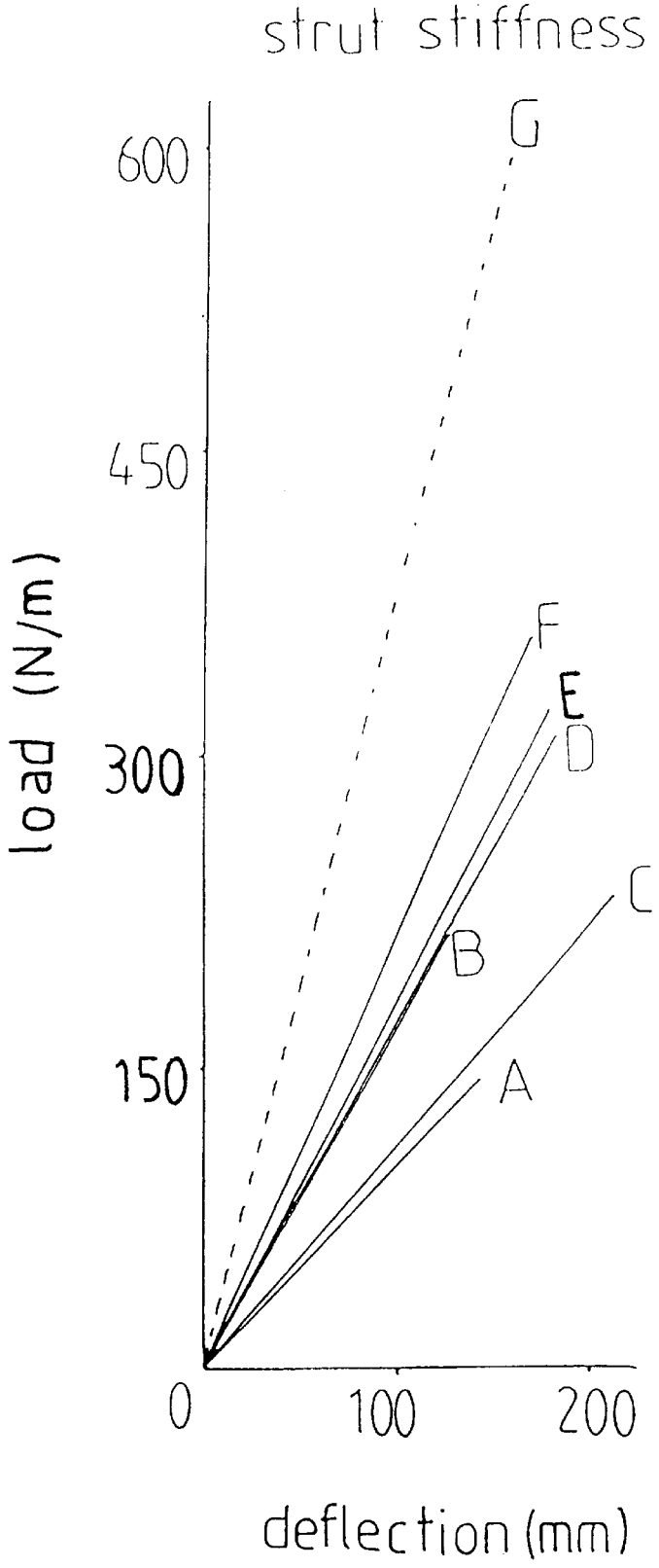
FIG. 4 is a graph representing strut stiffness comparing known struts with struts of type according to that of the invention.

FIG. 4 shows a graph representing strut stiffness of a number of different struts. The data obtained was based on a number of tests that were undertaken. Letters A–G represent different struts and their relationship between deflection and load.

Strut A is a U-shaped strut with flanges extending outwardly adjacent the end of the U-shaped section. This strut is currently being used by most manufacturers in the marketplace.

Strut B is a substantially V-shaped strut with flanges connected to ends of the V. It is currently being used in the marketplace but to a lesser extent.

Struts C–F are struts which have the cross-sectional shape of the strut shown in FIG. 1. The wall height of each of the struts is 70 mm, 83.5 mm, 85 mm and 90 mm respectively.

Strut G has the same profile as the strut of FIG. 1. A bar has been inserted into the enclosed structure. The wall height of this strut is 90 mm.

Struts A and B are made of steel sheeting that is 1.0 mm thick. Struts C–G are made of steel sheeting 0.55 mm thick.

The termination of each line on the graph represents the yield point of each of struts. That is, where the strut begins to lose its ability to spring back to its original shape when the load is removed.

STRUTS A–B

Struts A and B were used as a basis for comparison of what is currently available on the market. The results of the testing of these struts is discussed below.

STRUT C

Strut C showed similar strut stiffness to Strut A. However, the yield point of Strut A was considerably higher than the yield point of Strut A. Strut C had a yield point of 210 mm whilst the Strut A had a yield point of only 143 mm.

STRUTS D–F

Struts D–F had a much higher yield than strut B. As height of the strut increased, so did the yield point. Strut B had a yield point of 219 N/m whilst Struts D–F had yield points of 314 N/m, 327 N/m and 363 N/m, respectively. Strut F is considered the maximum height possible without creating problems with aesthetics.

STRUT G

Strut G had by far the largest yield point at 600N meters with a deflection figure of approximately the same as Strut A. It is envisaged that Strut G will be able to be produced for extremely wide doors without a disproportionate increase in weight.

Comparing Struts A and B with Struts F and G, there are a number of advantages which can be established:

(i) Strut F requires 27% less material than Strut A.

(ii) The yield point of Strut F is 165% of Strut A. Therefore, Strut F will be able to cope with 65% greater wind loads.

(iii) Strut G has a yield point 250% of that of Strut A.

(iv) The deflection for Strut F for a given fixed load is 80% of the deflection of Strut A.

(v) The deflection of Strut F for a given fixed load is 48% of the deflection of Strut B.

The lower weight of the reinforcing struts allows smaller springs and other components to be used. Further, fewer struts can also be used to achieve better results. Greater wind loadings can be achieved using the reinforcing struts. Also, wider doors can be manufactured than those currently available because the reinforcing struts can be produced to cope with increased loading. Cost savings may also be achieved.

Figure 5:
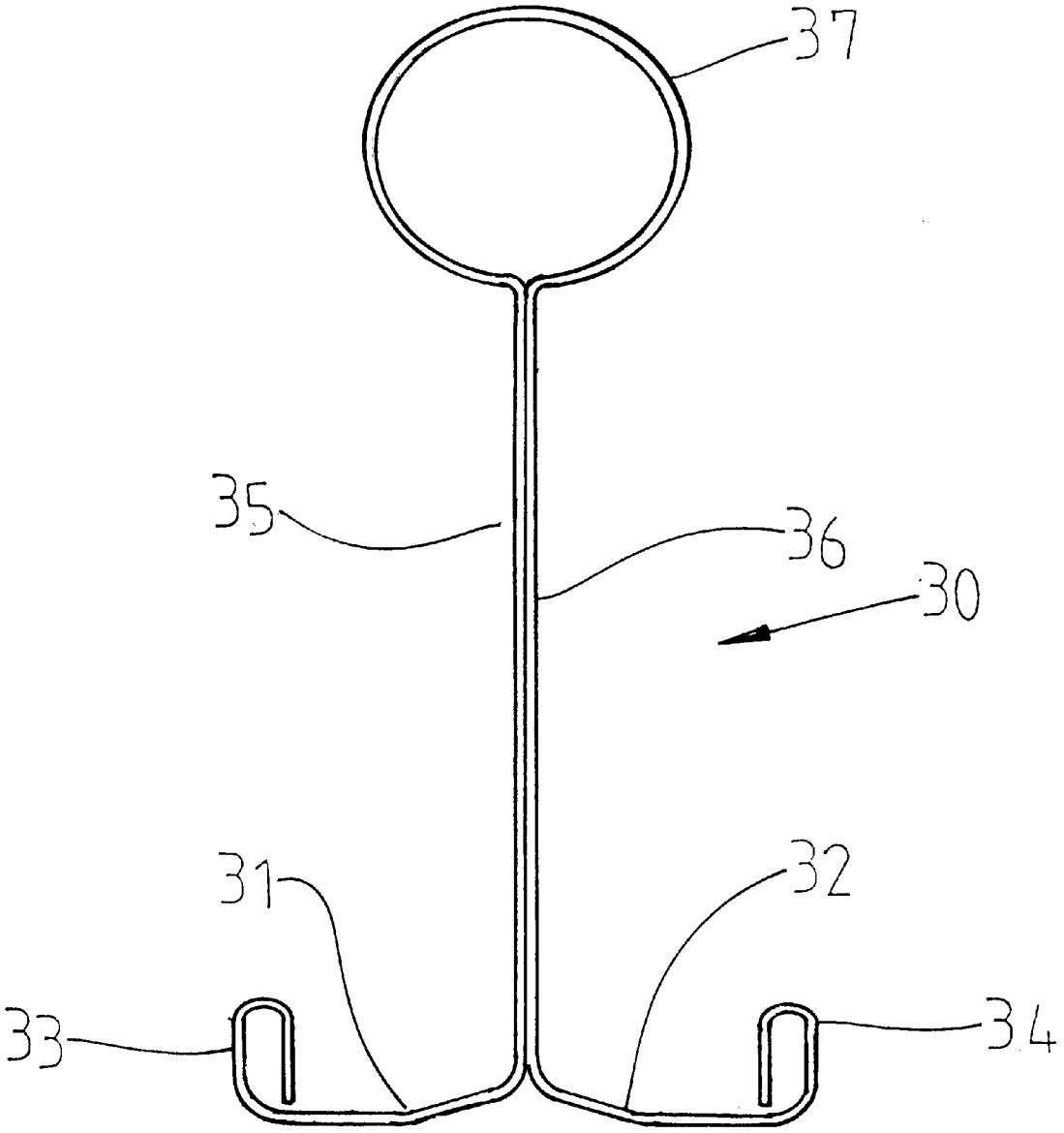
FIG. 5 is a front section view of a reinforcing strut according to a second embodiment of the present invention.

FIG. 5 is a front section view of a strut 30 according to a second embodiment of the present invention. The strut 30 has two feet 31, 32. A lip 33, 34 is formed at the end of each of the feet 31, 32. The two lips 33, 34 are substantially perpendicular to the feet. The tops of the two lips 33, 34 have been turned inwardly back on to themselves so as to provide a dull edge.

A wall is formed at the opposite end of each of the two feet. The two walls 35, 36 are substantially perpendicular to the two feet 31, 32. The walls abut one another and may be joined to each other in a similar manner to that described in relation to FIGS. 1, 2 and 3.

An enclosed structure 37 is formed at the ends of the two walls 35, 36. The enclosed structure 37 is generally circular in cross section. The second embodiment of FIG. 5 is generally identical to the embodiment of FIG. 1, except that the enclosed structure is generally circular in cross section, as opposed to generally square in cross section.

I claim:

1. A reinforcing strut for a sectional overhead door, the strut being made from a unitary piece of material and including a pair of oppositely directed feet for fastening the strut to the sectional overhead door, the feet having adjacent inner ends, a wall extending from each of the inner ends and at right angles to the feet with the walls being in contact with one another and fixed to one another at fixing locations arranged in two rows with each said row having a plurality of said fixing locations at spaced intervals along the strut with one of the rows being adjacent the feet and the other said row being spaced from the feet and adjacent an edge of the walls spaced from the feet.

2. The reinforcing strut of claim 1 wherein the strut is made using a roll forming operation.

3. The reinforcing strut of claim 1 wherein an enclosed structure is formed at the edge of the walls spaced from the feet.

4. The reinforcing strut of claim 3 wherein the enclosed structure is square in cross sectional shape.

5. The reinforcing strut of claim 3 wherein the enclosed structure is circular in cross sectional shape.

6. The reinforcing strut of claim 4 wherein a side of the enclosed structure is substantially at an angle of 135 degrees with respect to an adjacent said wall.

7. The reinforcing strut of claim 1 including an upstanding lip at a free edge of each said foot.

8. The reinforcing strut of claim 7 wherein each said lip is turned over onto itself.

9. The reinforcing strut of claim 2 wherein an enclosed structure is formed at the edge of the walls spaced from the feet.

10. The reinforcing strut of claim 9 wherein the enclosed structure is circular in cross sectional shape.

11. The reinforcing strut of claim 9 wherein the enclosed structure is square in cross sectional shape.

12. The reinforcing strut of claim 11 wherein a side of the enclosed structure is substantially at an angle of 135 degrees with respect to an adjacent said wall.

* * * * *